United States Patent [19]

Hauk

[11] Patent Number: 4,796,758

[45] Date of Patent: Jan. 10, 1989

[54] ASSEMBLY FOR STORAGE, TRANSPORTATION AND CHILLING OF EXPRESSED HUMAN MILK

[76] Inventor: David Hauk, 183 Florence Ave., Oakland, Calif. 94618

[21] Appl. No.: 92,166

[22] Filed: Sep. 2, 1987

[51] Int. Cl.[4] ..... B65D 81/38

[52] U.S. Cl. ..... 206/545; 215/11.6

[58] Field of Search ..... 206/545, 549, 571, 523; 215/11 C

[56] References Cited

U.S. PATENT DOCUMENTS

| | | | |
|---|---|---|---|
| 4,228,908 | 10/1980 | Tweeton | 206/545 |
| 4,266,407 | 5/1981 | Gibson | 206/545 |
| 4,429,793 | 2/1984 | Ehmann | 206/545 |
| 4,533,050 | 8/1985 | Bake, Jr. | 206/545 |
| 4,630,671 | 12/1986 | Sherman et al. | 206/545 |
| 4,648,512 | 3/1987 | Tarozzi et al. | 206/545 |
| 4,679,242 | 7/1987 | Brockhaus | 206/545 |

*Primary Examiner*—Joseph Man-Fu Moy

*Attorney, Agent, or Firm*—Limbach, Limbach & Sutton

[57] ABSTRACT

An improved portable case is provided to enable the chilling, storing and transportation of expressed human milk. The portable case includes several components, a durable and rugged case, an insulated chest, storage bottles and chilling means. The case has upper and lower compartments, wherein the upper compartment may be used to store a breast pump or a similar device. The lower compartment houses the insulated chest. Within the insulated chest are three sturdy and unbreakable storage bottles. The expressed milk is discharged into the storage bottles, which are chilled by coolant gel packs. Two of the three storage bottles are sandwiched upright between the coolant gel packs, which conform to the sides of the storage bottles, allowing uniform and maximum surface area chilling. The third storage bottle is perpendicularly placed adjacent to the other storage bottles, enabling the user to place and chill an eight ounce (8 oz.) beverage container atop the third storage bottle.

1 Claim, 1 Drawing Sheet

ASSEMBLY FOR STORAGE, TRANSPORTATION AND CHILLING OF EXPRESSED HUMAN MILK

TECHNICAL FIELD

The present invention is directed generally to a portable case, and more particularly to an improved portable case which is capable of chilling and storing expressed human milk.

BACKGROUND OF THE INVENTION

As women have entered the work force in increasing numbers, several dilemmas have developed. Women have assumed greater job responsibility, even as they have attempted to maintain their nurturing, maternal role. Many women who have chosen the dual roles of mother and provider return to the work force before full weaning of their infant has been accomplished.

Meanwhile, the medical profession has continued to advance the beneficial aspects of breast feeding, such as better nutrition and allergy prevention. Ofttimes mothers are encouraged to breast feed their child for a year or longer.

For the working mother, breast feeding poses several difficulties. In order to continue to successfully nurse, the mother must produce or "express" milk while she is apart from her child. She must express milk so as to replenish the supply of milk the infant consumes in her absence. She must produce milk in order to assure that lactation will not diminish due to lessened demand. She must also express milk to avoid physical discomfort. The working mother must then produce, store, chill and transport expressed human milk while in the workplace environment.

In the field of storing, transporting and chilling expressed human milk in the workplace, there are a number of devices which have been utilized. Each of these prior methods and device have multiple drawbacks.

Human milk is an ideal bacterial growth medium. Even though collection bottles and breast pumps are sterilized, bacteria from the skin generally manages to invade the expressed milk. Human milk has a natural bacteriostatic character, but unless the milk is promptly chilled, bacteria can rapidly multiply. Minimizing the temperature of the milk retards bacterial spoilage.

The most frequent practice of chiling and storing expressed human milk is to place the warm milk in the workplace refrigerator. This practice is imperfect for several reasons. A woman may feel that placing her milk in a communal refrigerator is indiscrete. Also the milk is not thoroughly, evenly, or rapidly chilled, since the cool air of the refrigerator is an anemic heat transfer medium. Moreover, freezing the milk in the refrigerator mandates lengthy defrosting before consumption. Finally, many women simply do not have ready access to a refrigerator, either due to the structure of their work environment or because their position entails travel.

Other prior methods and devices have sought to overcome these disadvantages. One method is to deposit the warm expressed milk in containers inside an insulated chest containing ice. This technique provides for very slow chilling, since like a refrigerator, it relies upon cool air alone to lower the milk's temperature. Also the carriers employed in this technique are bulky and difficult to carry. Moreover, these primitive carriers often do not provide for the storage and transportation of necessary equipment, such as a breast pump.

Still another method is to deposit the milk in a plastic bag, which is then packed in an insulated bottle or jar containing crushed ice. While this method allows for direct contact between the bagged milk and the ice, the bags tend to leak. Also, conventional insulated bottles have little interior capacity for both crushed ice and bagged milk. Therefore, the amount of milk which can be stored in such a manner is necessarily small.

A variation on the prior technique is to freeze water in a plastic bottle and place the bottle in an insulated jar. Warm milk is then poured into the jar around the frozen plastic bottle. The disadvantages to this technique are that warm milk from later expressions is mixed with cooled milk from earlier expressions, thereby raising the temperature of the already cooled milk. The potential for bacterial spoilage increases with every deposit of warm milk.

Still another technique is to place ice cubes directly in a heavy insulated bottle. Then at the workplace, the ice cubes are discarded and replaced with warm milk. This method has the same significant undesirable aspect as the prior method since the addition of new milk increases the temperature of the old, making the entire expression more susceptible to spoilage. Furthermore, the insulated bottle does not have sufficient thermal mass to completely cool the expressed milk to an acceptable and safe temperature.

SUMMARY OF THE INVENTION

The foregoing and other problems of prior methods and devices for the storing, chilling and transportation of expressed human milk are overcome by the present invention of an improved portable case of the type, including a foam insulated chest, storage bottles for the expressed milk, means for chilling the express human milk by thermal conduction and the capability to transport articles associated with the expression of milk such as a breast pump and extra consumable liquid.

It is therefore an object of the present invention to provide an easily portable case capable of simultaneously chilling, storing and transporting expressed human milk.

It is a further object of the present invention to provide a portable case in which articles used in the expressionof milk, such as a breast pump, may be easily stored in the upper compartment of the portable case.

It is still another object of the present invention to provide a portable case containing an insulated chest, chilling means and storage bottle allowing for the discrete and sanitary storage and chilling of expressed human milk.

Yet another object of the present invention is to provide storage bottles which allow a multitude of sequential human milk expressions to be stored without raising the temperature of earlier stored expressions.

A further object of the present invention is to provide a portable case wherein an eight ounce beverage container may be stored and cooled in the insulated chest, in addition to the storage bottles.

It is another object of the present invention to provide chilling means which conform to the shape of the surface of the storage bottles, so that maximum chilling of the stored milk by conduction is achieved.

These and other features, objectives and advantages of the present inventin will be more readily understood upon consideration of the following detailed description of certain embodiments of the present invention and the drawings.

DESCRIPTION OF THE PREFERRED EMBODIMENT

Figure 1:
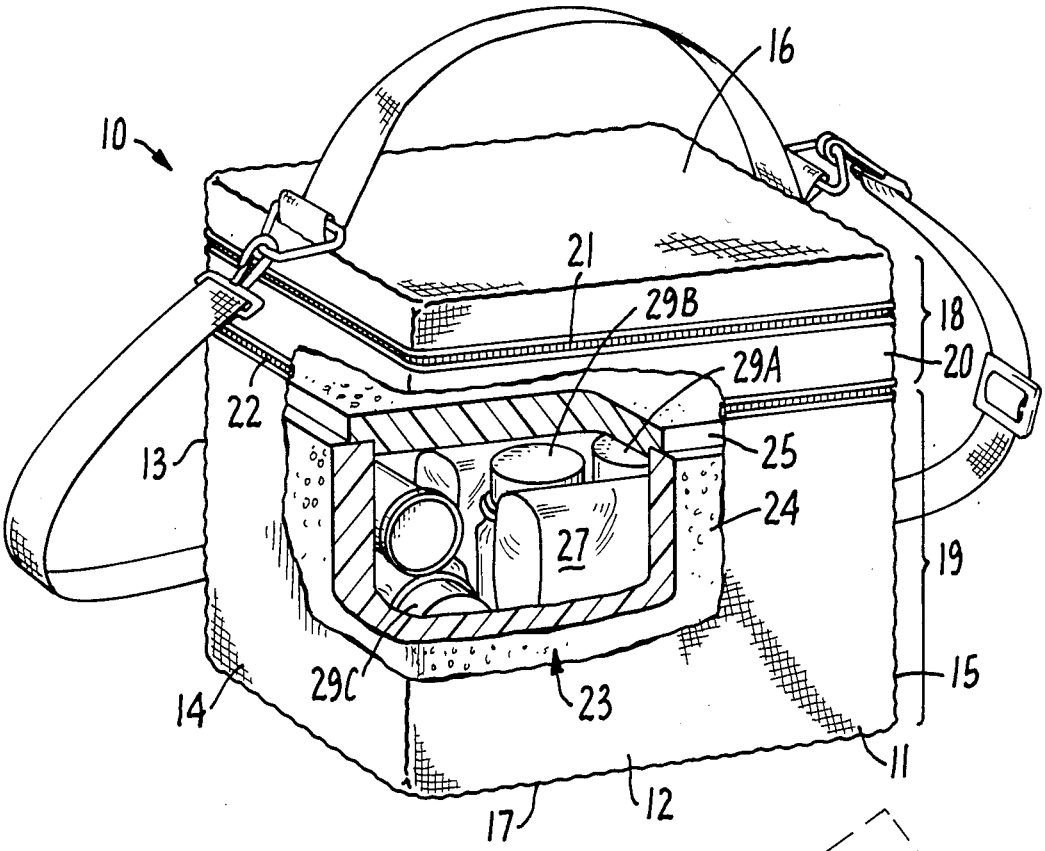
FIG. 1 is a perspective view of a storage apparatus in accordance with the present invention.
Figure 3:
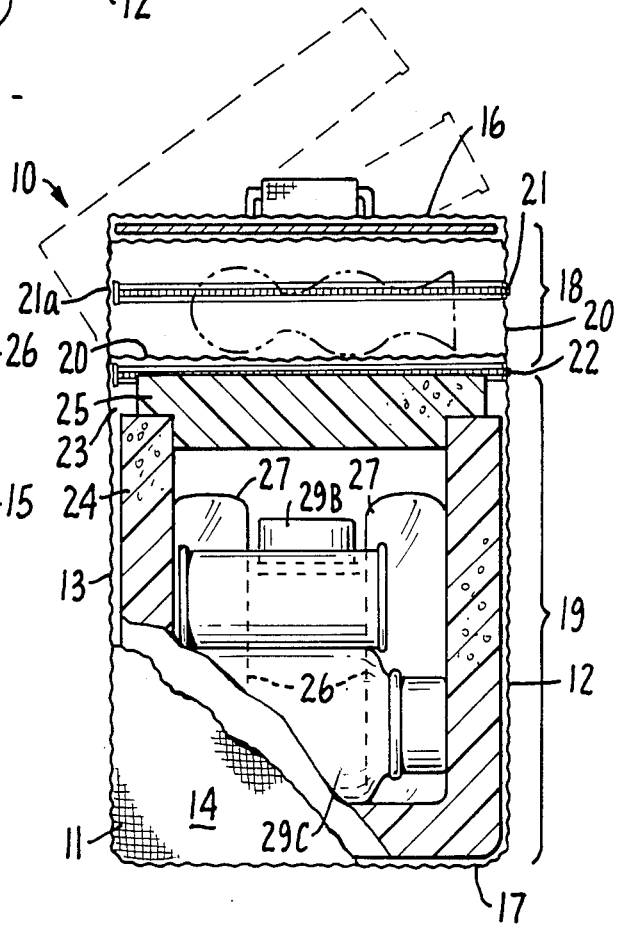
FIG. 3 is a front elevational view, partially broken away, of the storage apparatus shown in FIG. 1.

Referring now to the drawing with particular reference to FIGS. 1 and 3, there is shown a portable storage assembly 10 in accordance with the present invention. The storage assembly 10 includes a carrying case 11 in the form of a hollow, multicompartment, rectangular parallel piped case of lightweight material such as, for example, spun bonded polyester fabric. The case 11 has front and back panels 12 and 13, respectively, side panels 14 and 15 and top and bottom panels 16 and 17 respectively. The case 11 is divided into an upper compartment 18 and a lower compartment 19 by a wall 20 which is sewn in place and affixed to front and back panels 12 and 13, and side panels 14 and 15. A heavy duty zipper 21 encircles almost the entire perimeter of the upper compartment 18, allowing easy access to the interior of the upper compartment 18. At the zipper 21 the portion 21a of the perimeter which is zipperless acts as a hinge, so that when unzipped, the top panel 16 of the upper compartment 18 becomes a hinged lid for the upper compartment 18. The upper compartment 18 is roomy and capable of storing items such as a breast pump.

The lower compartment 19 of the case 11 is similar in nature and construction to the upper portion 18. A heavy duty zipper 22 almost encircles the perimeter of the lower compartment 19. When unzipped, the wall 20 of the lower compartment 19 becomes a hinged lid, allowing access to the interior cavity or chamber 23 of the lower compartment 19.

Inside the interior cavity or chamber 23 is an insulated chest 24, such as of one-inch (1") thick expanded polystyrene foam, with a fitted lid 25. The foam acts as an insulation and protection device for the chilling means and storage bottles. The shaped walls of the chest 24 force the chilling means, such as for example, coolant bags, to press against and conform to the storage bottles. The interior and exterior corners of the chest 24 are rounded, so as to provide maximum exposed surface area for the chilling of expressed human milk and so as to press and conform the chilling means to the storage bottles. The dimensions of chest 24 are 8'¼" high ×9'½" wide ×7'½" deep. Chest 24 is generally rectangular in shape.

Figure 2:
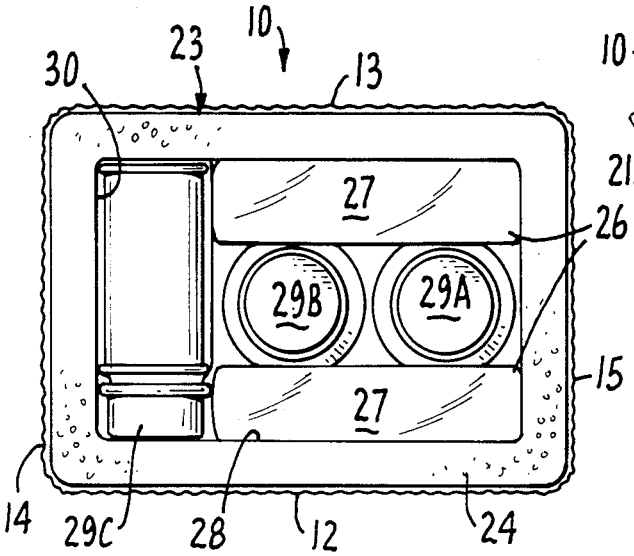
FIG. 2 is a schematic view of the lower compartment of the storage apparatus shown in FIG. 1.

FIG. 2 depicts the storage bottle and chilling means assembly generally designated 26. The chilling means comprises two coolant gel packs 27, abutting the length walls 28 of chest 24. Coolant gel packs such as those manufactured by Gott Corporation may be used.

Storage bottles 29A and 29B are sandwiched between coolant gel packs 27. A third storage bottle 29C is placed on its side, perpendicular to storage bottles 29A and 29B, abutting a short wall 30 of chest 24.

Storage bottles 29A, 29B and 29C have a volume capacity of nine ounces and are generally rectangular in appearance. The pair of broad sides created by the rectangular shape of storage bottles 29A, 29B and 29C allows for a high surface area to volume ratio, offering maximum surface area to the chilling means and maximizing conductive cooling of the stored expressed milk.

Storage bottles 29A, 29B and 29C allow the user to express milk up to three times, without mixing earlier and later expressions. After the third expression, storage bottles 29A, 29B and 29C may be consolidated into a single storage bottle, allowing the remaining storage bottles to be used for further expressions.

FIG. 3 represents a partially broken away view of the case 11 with chest 24 exposed. A container such as an eight ounce (8 oz.) beverage can may be placed atop the storage bottle 29C.

The terms and expressions which have been employed herein are used as terms of description and not of limitation, and there is no intention, in the use of such terms and expressions, of excluding equivalence of the feature shown and described, or portions thereof, it being recognized that various modifications are possible within the scope of the invention claimed.

What is claimed is:

1. An improved storage assembly for storage, transportation and chilling of expressed human milk comprising:

a plurality of thermally conductive storage bottles each substantially rectangular in horizontal cross-section to provide at least a pair of broad sides for conduction cooling of the contents of said bottles;

a plurality of coolant bags for chilling said storage bottles, said bags positioned in contact with both of the broad sides of at least a plurality of said bottles;

a foam insulated chest having a chamber for housing said bottles and said bags;

said chamber, said storage bottles and said bags dimensioned to provide direct contact between at least a plurality of said bags with at least a plurality of said bottles;

a fitted lid for closing said chamber;

a carrying case having:

a front and a back panel, two sides panels, a top panel and a bottom panel;

a wall panel joined to the front, back and side panels dividing the case into a first compartment containing said chest and a second compartment having capacity to store and transport a breast pump;

a zipper below said wall pump extending around said front and said side panels and portions on opposite sides of said back panel providing access into said first compartment; and means for providing access to said second compartment.

* * * * *